US011673759B2

(12) United States Patent
Nakanishi et al.

(10) Patent No.: US 11,673,759 B2
(45) Date of Patent: Jun. 13, 2023

(54) MEDIUM EJECTING APPARATUS INCLUDING STOPPER TO RISE IN RESPONSE TO OPERATION OF TRAY

(71) Applicant: PFU LIMITED, Kahoku (JP)

(72) Inventors: Isao Nakanishi, Kahoku (JP); Hideyuki Okumura, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 17/450,821

(22) Filed: Oct. 13, 2021

(65) Prior Publication Data

US 2022/0169472 A1 Jun. 2, 2022

(30) Foreign Application Priority Data

Nov. 30, 2020 (JP) ..... JP2020-198605

(51) Int. Cl.
*B65H 31/02* (2006.01)

(52) U.S. Cl.
CPC ..... *B65H 31/02* (2013.01); *B65H 2402/46* (2013.01); *B65H 2405/11* (2013.01)

(58) Field of Classification Search
CPC ..... B65H 31/02; B65H 2402/46; B65H 2405/11; B65H 2405/31; B65H 2405/32; B65H 2405/35; B65H 1/027; B65H 1/04
See application file for complete search history.

(56) References Cited

U.S. PATENT DOCUMENTS 5,984,300 A * 11/1999 Nishiberi ..... B65H 1/04 271/171
7,547,015 B2 * 6/2009 Lee ..... B65H 31/20 271/224
7,712,734 B2 * 5/2010 Kang ..... B65H 1/04 271/9.01
8,292,290 B2 * 10/2012 Ishii ..... B65H 1/266 271/9.01
8,424,871 B2 * 4/2013 Ino ..... G03G 15/602 271/223
8,430,399 B1 * 4/2013 Huang ..... B65H 1/04 271/223
9,010,754 B2 * 4/2015 Matsumoto ..... B65H 31/34 271/223
2005/0285330 A1 * 12/2005 Tazika ..... B41J 13/103 271/157
2006/0291342 A1 * 12/2006 Kang ..... B65H 1/04 369/30.78
2014/0070482 A1 3/2014 Matsumoto

FOREIGN PATENT DOCUMENTS

JP 2014-51361 A 3/2014
JP 2019-137559 A 8/2019

* cited by examiner

*Primary Examiner* — Thomas A Morrison

(74) *Attorney, Agent, or Firm* — Lewis Roca Rothgerber Christie LLP

(57) ABSTRACT

A medium ejecting apparatus includes an ejection roller to eject medium, a first tray to place the medium ejected by the ejection roller, a second tray provided so as to be pulled out from the first tray, and a stopper accommodated in the first tray together with the second tray in a laid state, rotatably supported at a downstream end portion in a medium ejecting direction of the second tray, and provided with a slid portion. The first tray is provided with a sliding portion to slide with respect to the slid portion in response to an operation in which the second tray is pulled out from the first tray to raise the stopper.

4 Claims, 14 Drawing Sheets

MEDIUM EJECTING APPARATUS INCLUDING STOPPER TO RISE IN RESPONSE TO OPERATION OF TRAY

CROSS-REFERENCE TO RELATED APPLICATIONS

This application is based upon and claims the benefit of priority of prior Japanese Patent Application No. 2020-198605, filed on Nov. 30, 2020, the entire contents of which are incorporated herein by reference.

TECHNICAL FIELD

Embodiments discussed in the present specification relate to medium ejection.

BACKGROUND

Recently, a medium ejecting apparatus, such as a scanner, conveying a medium, to image the medium and ejecting the medium, is required to speed up a processing. Further, such a medium ejecting apparatus is required to image a passport or a booklet, etc., in addition to a paper, etc. In the medium ejecting apparatus, the medium conveyance path is required to be formed in a planar shape so as not to be bent in order to satisfactorily convey the passport or the booklet, etc. In general, in the medium ejecting apparatus, a stopper is provided in a tray to place the ejected medium. When a user forgets to set the stopper, the medium ejected from the medium conveyance path formed in a planar shape may be flown out from the tray and scattered.

A sheet ejecting apparatus including an ejection tray in which an ejected sheet is stacked, and an ejection extension tray which can extend and retract in a sheet ejecting direction with respect to the ejection tray is disclosed (see Japanese Unexamined Patent Application Publication (Kokai) No. 2019-137559). The sheet ejecting apparatus includes a front end regulating portion provided in connection with the ejection extension tray on a downstream side in the sheet ejecting direction of the ejection extension tray, and so as to be rotated about a vicinity of a connecting portion with the ejection extension tray.

An imaging apparatus including a lid portion which can open and close with respect to a housing, to support a sheet in an open state, an extension portion accommodated in the lid portion to support the sheet, and an interlocking mechanism to rotate the extension portion in conjunction with an opening and closing of the lid portion is disclosed (see Japanese Unexamined Patent Application Publication (Kokai) No. 2014-51361). In the imaging apparatus, the extension portion is rotated to pop out from an inside of the lid portion by the interlocking mechanism, when the lid is opened.

SUMMARY

According to some embodiments, a medium ejecting apparatus includes an ejection roller to eject medium, a first tray to place the medium ejected by the ejection roller, a second tray provided so as to be pulled out from the first tray, and a stopper accommodated in the first tray together with the second tray in a laid state, rotatably supported at a downstream end portion in a medium ejecting direction of the second tray, and provided with a slid portion. The first tray is provided with a sliding portion to slide with respect to the slid portion in response to an operation in which the second tray is pulled out from the first tray to raise the stopper.

DESCRIPTION OF EMBODIMENTS

It is to be understood that both the foregoing general description and the following detailed description are exemplary and explanatory, and are not restrictive of the invention, as claimed.

Hereinafter, a medium ejecting apparatus according to an embodiment, will be described with reference to the drawings. However, it should be noted that the technical scope of the invention is not limited to these embodiments, and extends to the inventions described in the claims and their equivalents.

Figure 1:
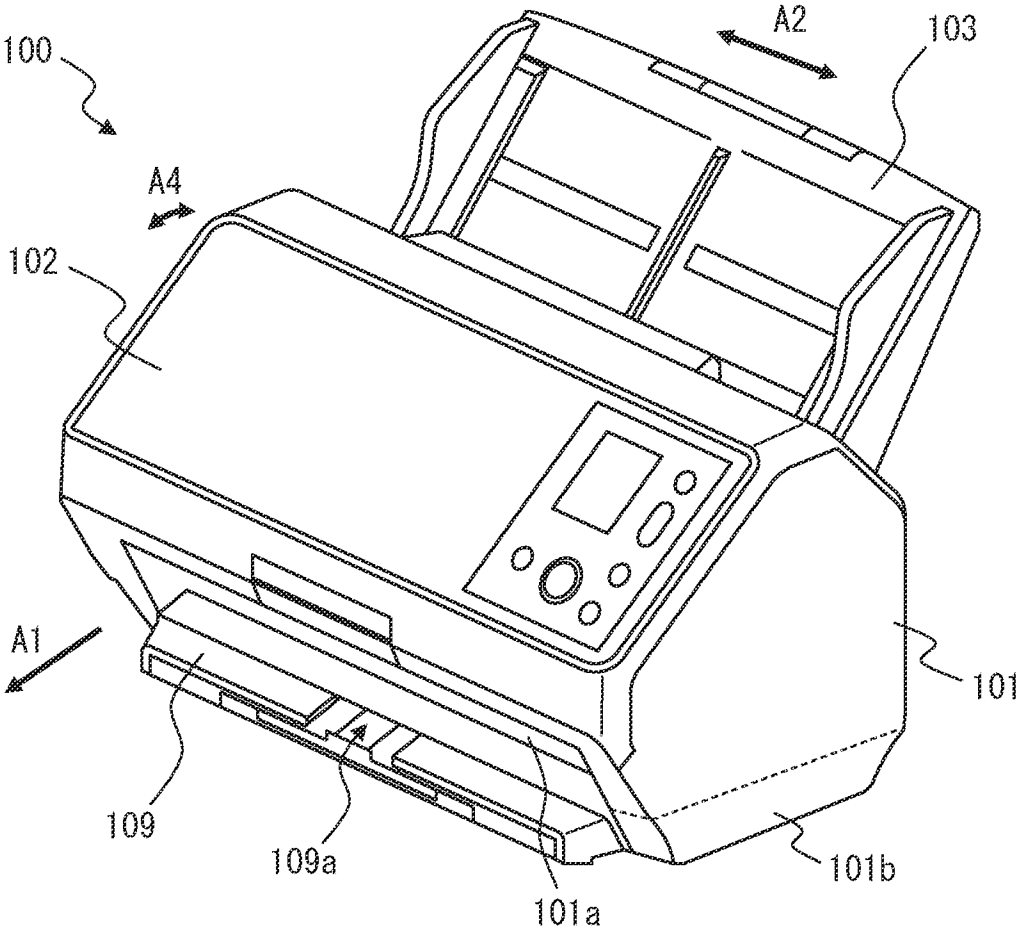
FIG. 1 is a perspective view illustrating a medium ejecting apparatus 100 according to an embodiment.
Figure 2:
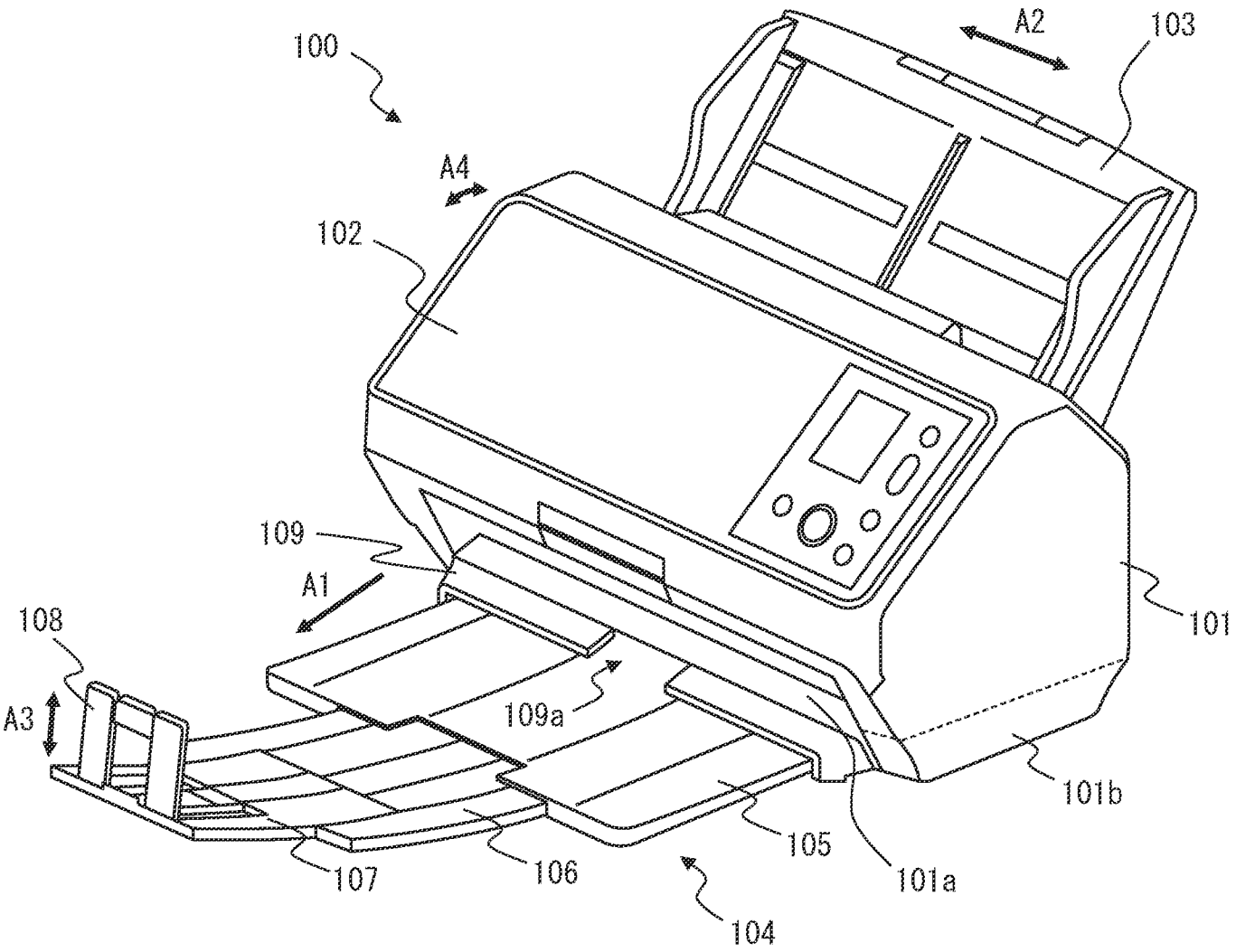
FIG. 2 is a perspective view illustrating the medium ejecting apparatus 100 according to an embodiment.

FIGS. 1 and 2 are perspective views illustrating a medium ejecting apparatus 100 configured as an image scanner. FIG. 1 illustrates the medium ejecting apparatus 100 in a state where the ejection tray 104 is accommodated. FIG. 2 illustrates the medium ejecting apparatus 100 in a state where the ejection tray 104 is set.

The medium ejecting apparatus 100 conveys, images, and ejects a medium being a document. A medium is a paper, a thick paper, a card, a brochure, a passport, etc. The paper or the thick paper includes a large-sized medium having a maximum size (A4 size or A3 size, etc.) supported by the medium ejecting apparatus 100, a small-sized medium such as a business card or a receipt, and a medium-sized medium (A5 size, A6 size, etc.) smaller than the large-sized medium and larger than the small-sized medium. The medium ejecting apparatus 100 may be a fax machine, a copying machine, a multifunctional peripheral (MFP), etc. A conveyed medium may not be a document but may be an object being printed on etc., and the medium ejecting apparatus 100 may be a printer etc.

The medium ejecting apparatus 100 includes a lower housing 101, an upper housing 102, a medium tray 103 and an ejection tray 104, etc. An arrow A1 in FIGS. 1 and 2 indicates a medium ejecting direction. Hereinafter, an upstream refers to an upstream in the medium ejecting direction A1, and a downstream refers to a downstream in the medium ejecting direction A1. An arrow A2 indicates a width direction perpendicular to the medium ejecting direction A1. An arrow A3 indicates a height direction perpendicular to an upper surface of the ejection tray 104.

The lower housing 101 and the upper housing 102 are an example of a housing. The upper housing 102 is located at a position covering the upper surface of the medium ejecting apparatus 100 and is engaged with the lower housing 101 by hinges. The upper housing 102 is provided so as to be opened and closed in a direction of an arrow A4 at a time of medium jam, during cleaning the inside of the medium ejecting apparatus 100, etc. The lower housing 101 and the upper housing 102 include an ejection port 101*a* to eject the medium. The lower housing 101 includes an accommodation portion 101*b* to accommodate the ejection tray 104.

The medium tray 103 is engaged with the lower housing 101 in such a way as to be able to place a medium to be conveyed.

The ejection tray 104 is provided below an ejection port 101*a*, and is attached to the lower housing 101 so as to load the medium ejected from the ejection port 101*a*. The ejection tray 104 is accommodated in the accommodation portion of the lower housing 101 when the medium ejecting apparatus 100 is not used. The ejection tray 104 is pulled out from the lower housing 101 in the medium ejecting direction A1, and loads the medium ejected from the ejection port 101*a* when the medium ejecting apparatus 100 is used. The ejection tray 104 includes a first ejection tray 105, a second ejection tray 106, a third ejection tray 107, a stopper 108 and a cover 109.

The first ejection tray 105 is provided so as to be pulled out from the lower housing 101 in the medium ejecting direction A1. The first ejection tray 105 is accommodated inside the lower housing 101 when not used, and is pulled out from the lower housing 101, to place the ejected medium when used. The second ejection tray 106 is an example of a first tray, and is provided so as to be pulled out from the first ejection tray 105 in the medium ejecting direction A1. The second ejection tray 106 is accommodated in the first ejection tray 105 when not used, and is pulled out from the first ejection tray 105, to place the ejected medium, particularly large size media when used. The third ejection tray 107 is an example of a second tray, and is provided so as to be pulled out from the second ejection tray 106 in the medium ejection direction A1. The third ejection tray 107 is accommodated in the second ejection tray 106 when not used, and is pulled out from the second ejection tray 106, to place the ejected medium, particularly larger size media when used.

The stopper 108 is provided foldably with respect to the third ejection tray 107, to stop a front end of the ejected medium, and regulate the front end of each medium, in a risen state.

The cover 109 is a cover for covering the first ejection tray 105, the second ejection tray 106, the third ejection tray 107 and the stopper 108 accommodated in the lower housing 101. The cover 109 prevents dust, etc., from entering the lower housing 101. The cover 109 is provided with a recess portion 109*a* opened upward at a downstream end portion in the medium ejecting direction A1, and at a position facing the stopper 108 in the width direction A2. Even when the first ejection tray 105, the second ejection tray 106 and the third ejection tray 107 are accommodated in the lower housing 101 while the stopper 108 is risen by a user, the recess portion 109*a* suppresses the stopper 108 from colliding with and being damaged by the cover 109.

The first ejection tray 105 may not be provided so as to be pulled out and accommodated. The first ejection tray 105 may be attached to the lower housing 101, so as to be folded, detached or fixed. The second ejection tray 106 may not be provided so as to be pulled out and accommodated. The second ejection tray 106 may be attached to the first ejection tray 105, so as to be folded, detached or fixed. The first ejection tray 105 may be omitted, and the second ejection tray 106 may be directly attached to the lower housing 101, so as to be pulled out, folded, detached or fixed.

Figure 3:
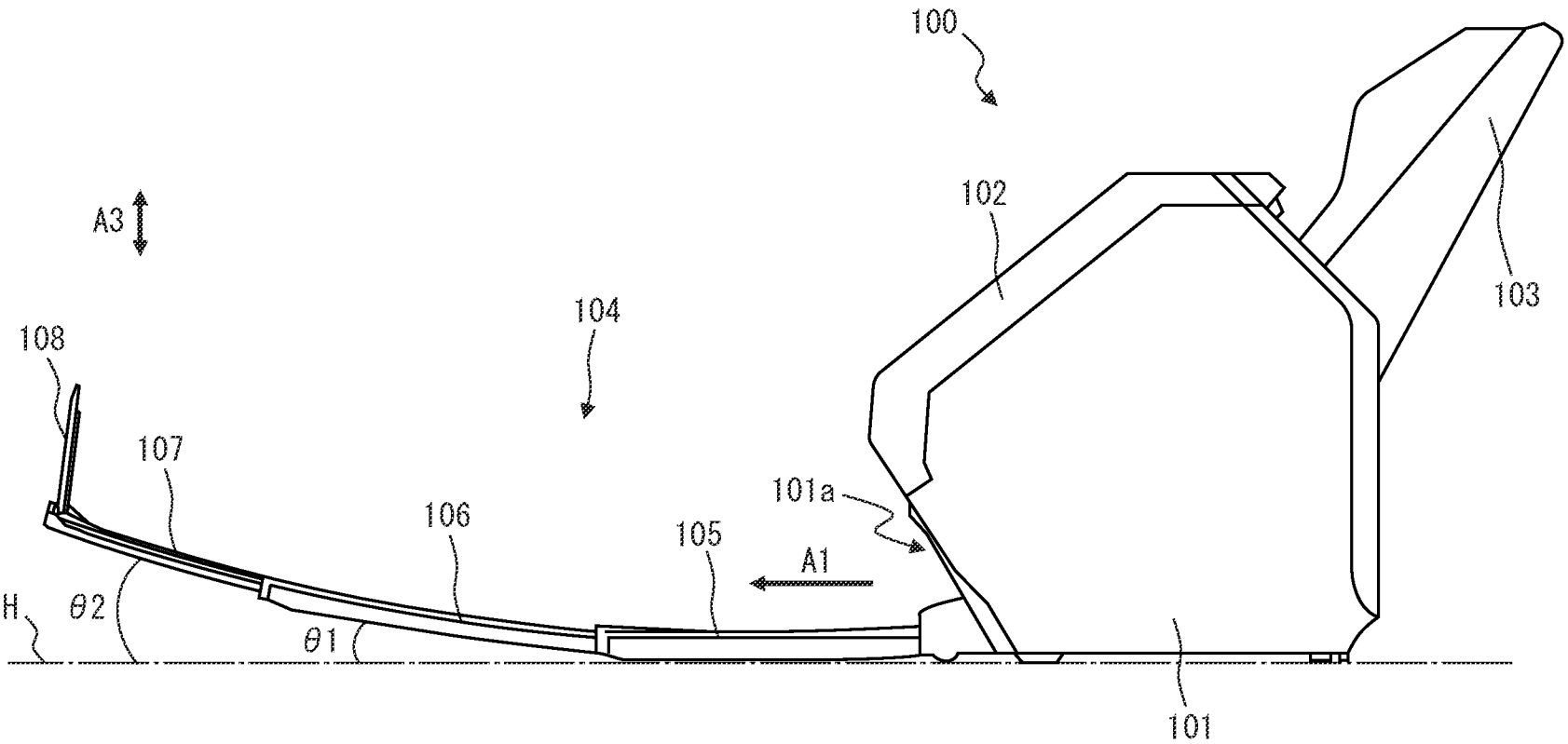
FIG. 3 is a side view of the medium ejecting apparatus 100 from the side.

FIG. 3 is a side view of the medium ejecting apparatus 100, as viewed from the side.

As illustrated in FIG. 3, the ejection tray 104 is provided so as to be substantially parallel to a horizontal plane H (to an installation surface on which the medium ejecting apparatus 100 is installed). An angle formed by the first ejection tray 105 and the horizontal plane is 10° or less, and is preferably 0°. An angle θ1 formed by the second ejection tray 106 and the horizontal plane is more than 0° and 15° or less, and is preferably 10°. An angle θ2 formed by the third ejection tray 107 and the horizontal plane is more than 15° and 25° or less, and is preferably 18°. The angle θ1 formed by the second ejection tray 106 and the horizontal plane is more than the angle formed by the first ejection tray 105 and the horizontal plane, and the angle θ2 formed by the third ejection tray 107 and the horizontal plane is more than the angle θ1 formed by the second ejection tray 106 and the horizontal plane.

As will be described later, since the medium conveyance path of the medium ejecting apparatus 100 is formed in a substantially planar shape so as not to be bent, the medium is ejected from the ejection port 101*a* at high speed. Since the ejection tray 104 is provided so as to be substantially horizontal, particularly in the vicinity of the ejecting port 101*a* in the medium ejecting apparatus 100, the front end of the medium ejected from the medium conveyance path is prevented from colliding with the ejection tray 104 at an angle close to vertical, and being damaged.

FIGS. 4 to 9 are schematic diagrams for illustrating the stopper 108. FIGS. 4 to 9 illustrate the first ejection tray 105, the second ejection tray 106, the third ejection tray 107 and the stopper 108 in a state of being removed from the lower housing 101.

Figure 4:
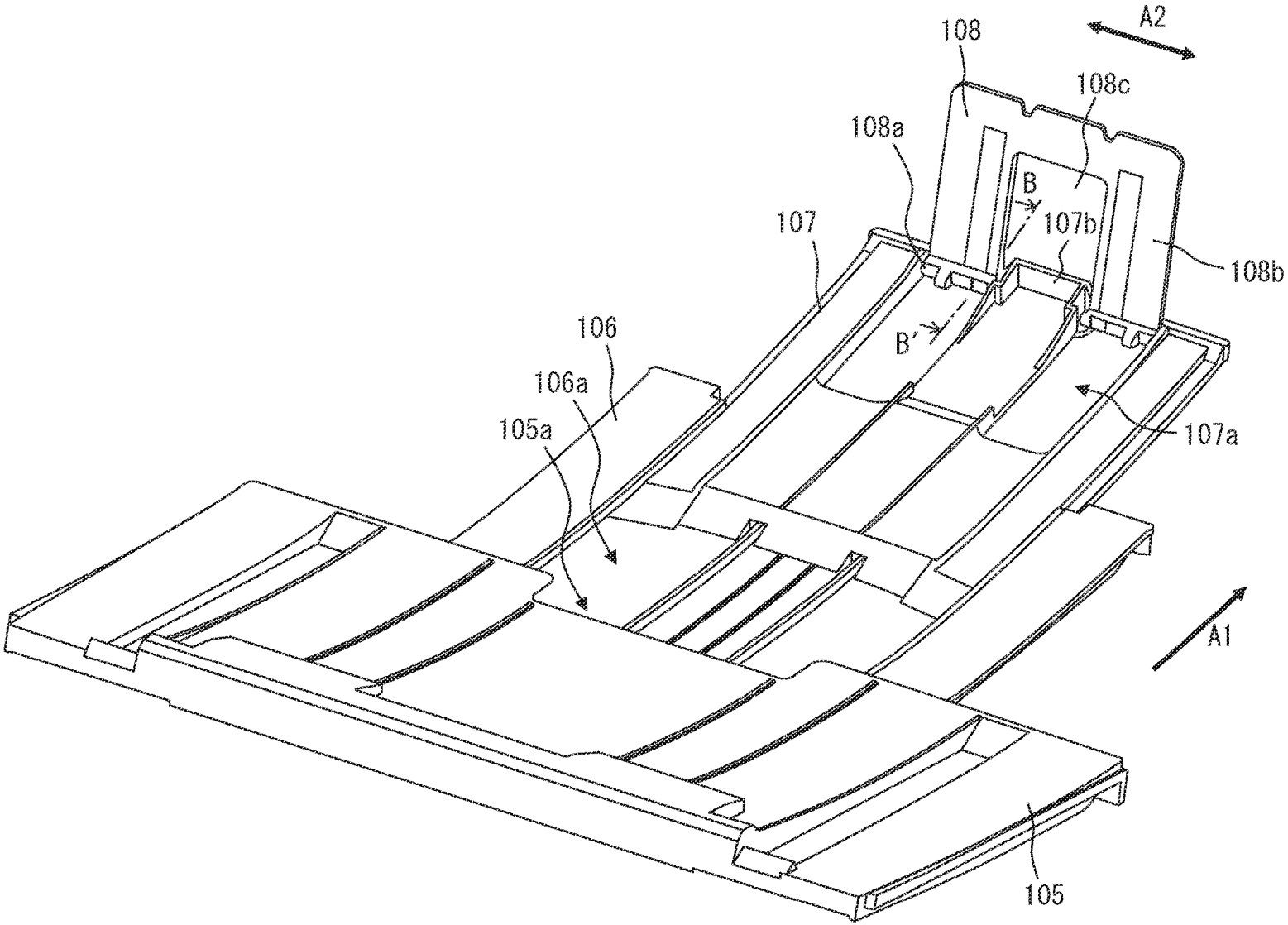
FIG. 4 is a schematic diagram for illustrating a stopper 108.

FIG. 4 illustrates a state where the second ejection tray 106 and the third ejection tray 107 are pulled out from the first ejection tray 105, and the stopper 108 is set. As illustrated in FIG. 4, the third ejection tray 107 is provided with an opening portion 107*a* penetrating in the height direction A3 to accommodate the stopper 108. The second ejection tray 106 is provided with a recess portion 106*a* opened upward to accommodate the third ejection tray 107 and the stopper 108. The first ejection tray 105 is provided with an accommodation portion (not shown) to accommodate the second ejection tray 106, the third ejection tray 107 and the stopper 108. The first ejection tray 105 is provided with a recess portion 105*a* opened upward at a downstream end portion in the medium ejecting direction A1, and a position facing the stopper 108 in the width direction A2.

An arm 108*a* is provided at one end of the stopper 108, and the arm 108*a* is engaged with a recess (not shown) provided at a downstream end portion 107*b* in the medium ejecting direction A1 of the third ejection tray 107. Thus, the stopper 108 is rotatably supported at the downstream end portion 107*b* in the medium ejecting direction A1 of the third ejection tray 107 about the arm 108*a* as a rotation axis. Further, the stopper 108 includes a regulating surface 108*b* to align by regulating the front end of the medium. The regulating surface 108*b* is located at a position facing the front end of the medium ejected on the ejection tray 104, by the stopper 108 rising in respect to the third ejection tray 107. Thus, the regulating surface 108*b* stops the front end of the medium ejected on the ejection tray 104, and aligns by regulating the front end of each medium. As illustrated in FIG. 4, when the second ejection tray 106 and the third ejection tray 107 are pulled out from the first ejection tray 105, the regulating surface 108*b* can stop the front end of the ejected large-sized medium and satisfactorily align the front end of the large-sized medium.

The stopper 108 includes a notch 108*c* for exposing the downstream end portion 107*b* in the medium ejecting direction A1 of the third ejection tray 107. The user can directly grasp the end portion 107*b* of the third ejection tray 107 via the notch 108*c*, and thereby, easily pull out the third ejection tray 107 from the second ejection tray 106.

Figure 5:
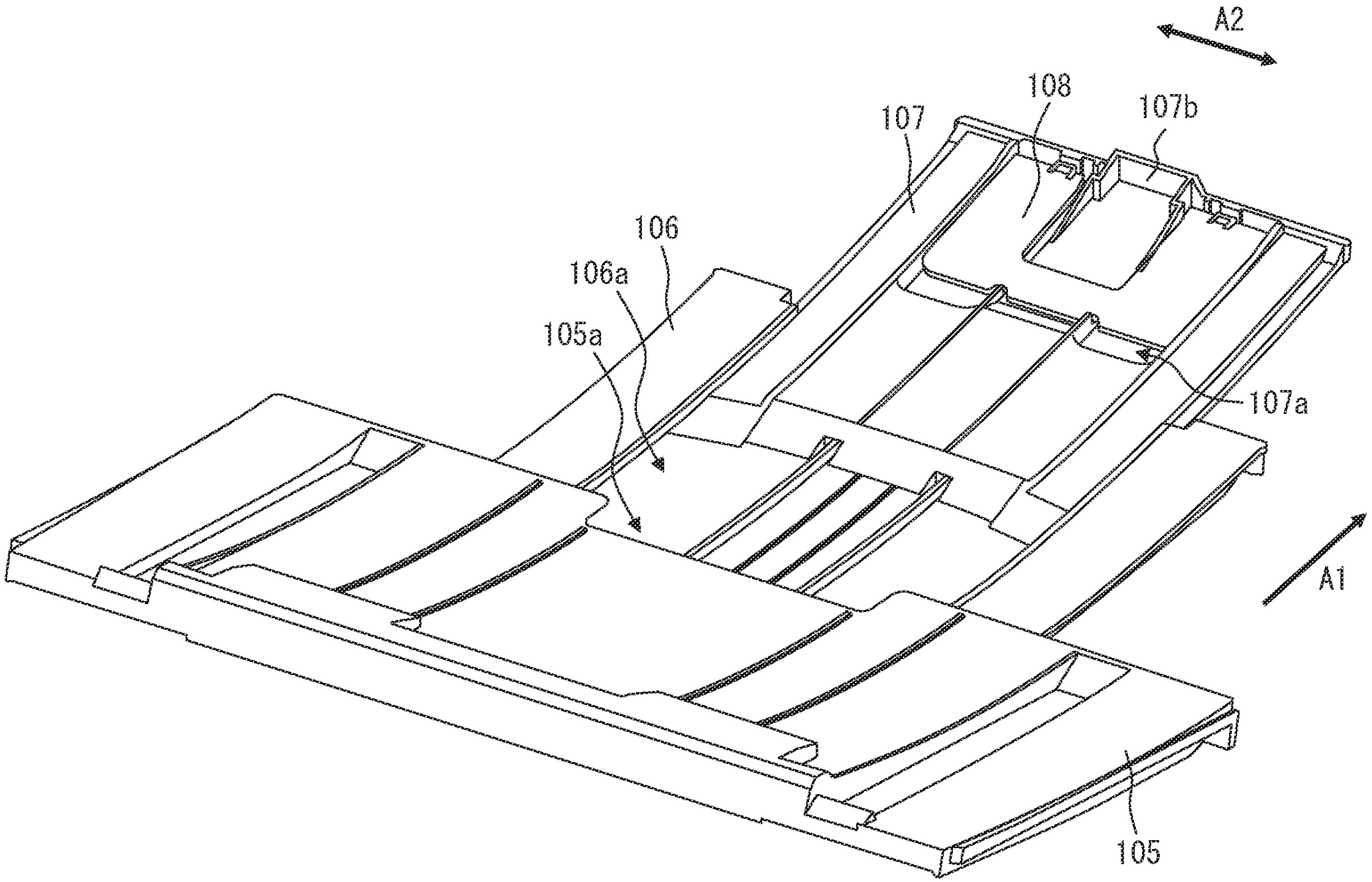
FIG. 5 is a schematic diagram for illustrating the stopper 108.

FIG. 5 illustrates a state where the stopper 108 is laid from the state shown in FIG. 4. As illustrated in FIG. 5, the stopper 108 is folded and accommodated in the opening portion 107*a* of the third ejection tray 107 by being put down with respect to the third ejection tray 107 (being in a laid state).

Figure 6:
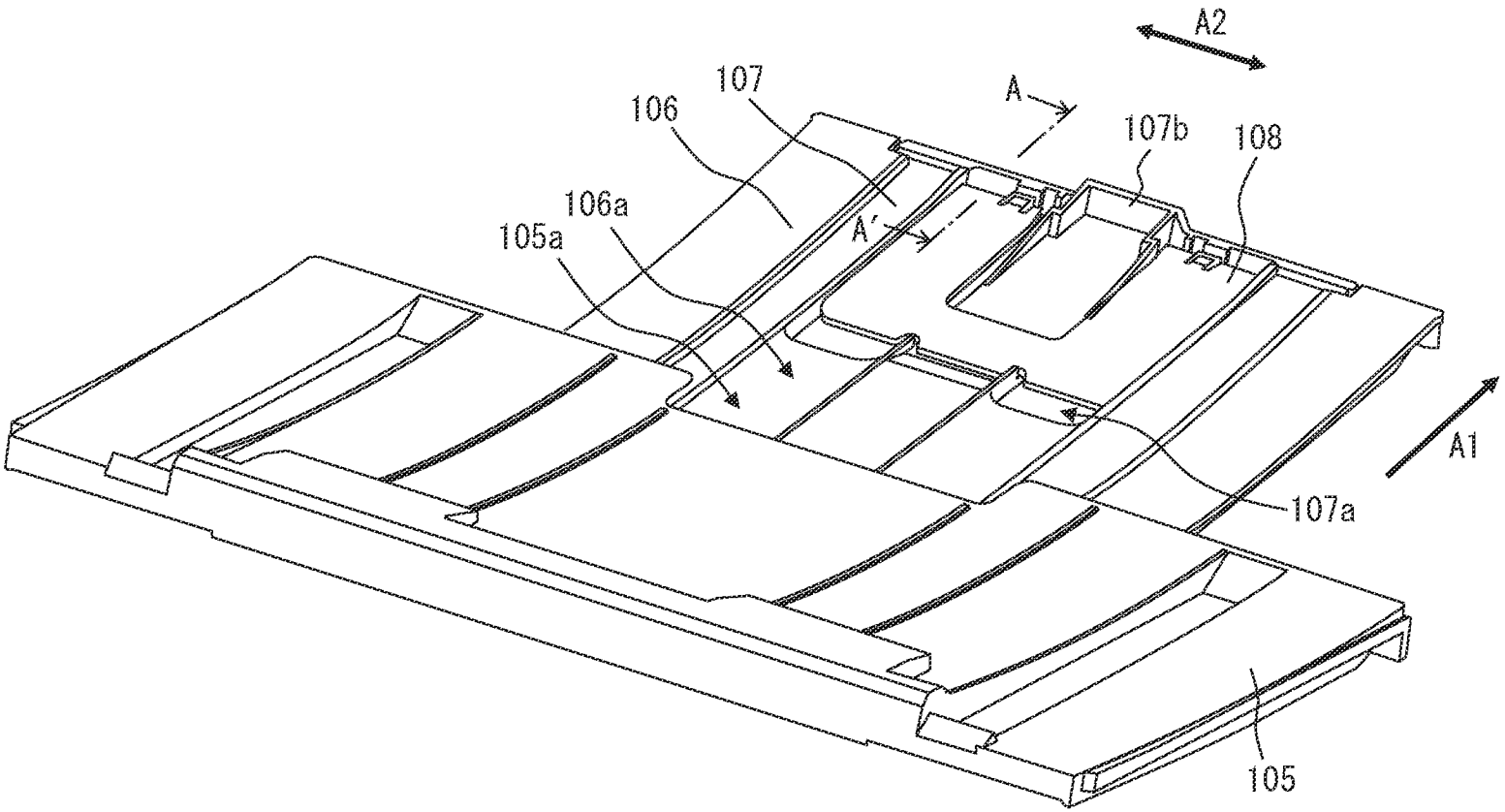
FIG. 6 is a schematic diagram for illustrating the stopper 108.

FIG. 6 illustrates a state where the third ejection tray 107 and the stopper 108 are accommodated in the second ejection tray 106 from the state shown in FIG. 5. As shown in FIG. 6, the stopper 108 is accommodated in the recess 106*a* of the second ejection tray 106, together with the third ejection tray 107, in a state of being laid and accommodated in the third ejection tray 107.

Figure 7:
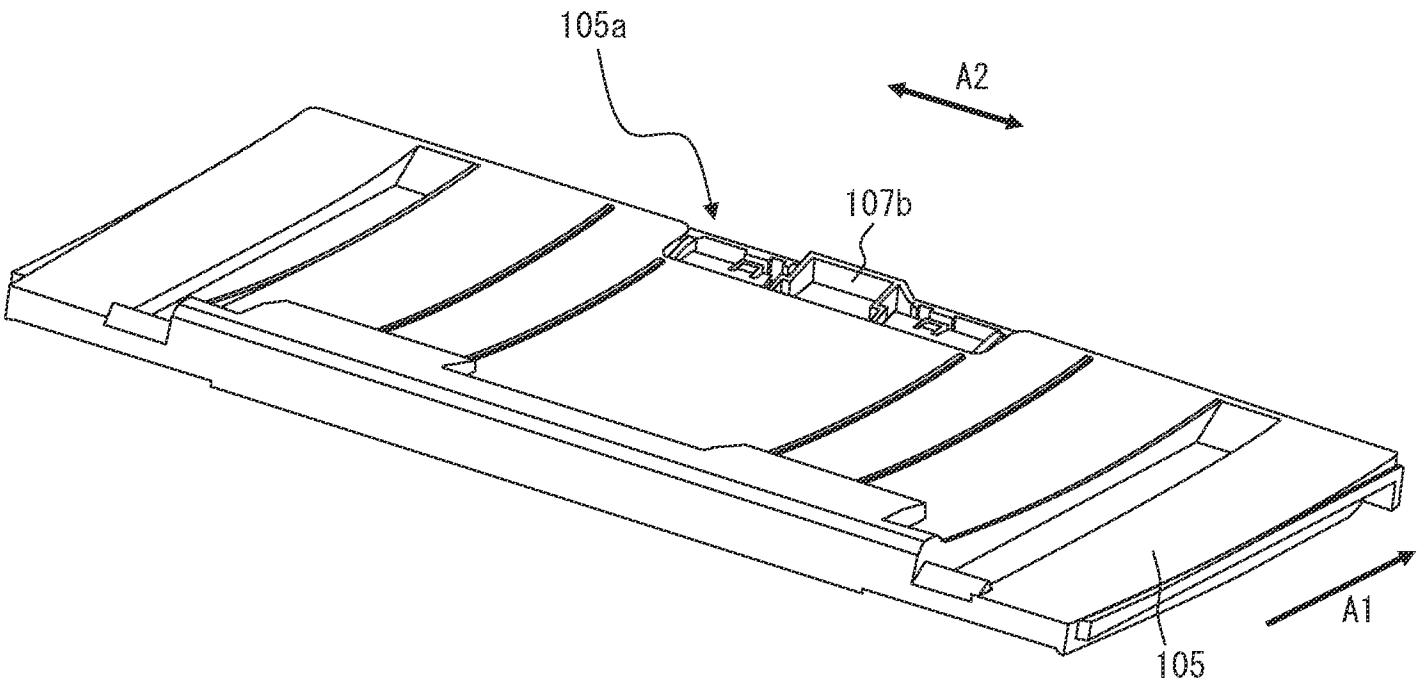
FIG. 7 is a schematic diagram for illustrating the stopper 108.

FIG. 7 illustrates, a state where the second ejection tray 106, the third ejection tray 107 and the stopper 108 are further accommodated in the first ejection tray 105 from the state shown in FIG. 6. As illustrated in FIG. 7, the stopper 108 is accommodated in the accommodation portion of the first ejection tray 105 together with the second ejection tray 106 and the third ejection tray 107, in a state of being laid and accommodated in the third ejection tray 107.

Further, as illustrated in FIG. 1, the first ejection tray 105, the second ejection tray 106, the third ejection tray 107 and the stopper 108 are accommodated in the lower housing 101. As described above, the recess portion 106*a*, the recess portion 105*a*, and the recess portion 109*a* opened upward are provided in the second ejection tray 106, the first ejection tray 105, and the cover 109, respectively, and the notch portion 108*c* is provided in the stopper 108. Thus, the end portion 107*b* of the third ejection tray 107 is exposed in a state where the first ejection tray 105, the second ejection tray 106, the third ejection tray 107 and the stopper 108 are accommodated in the lower housing 101. Therefore, the user can directly grasp the end portion 107*b* of the third ejection tray 107, and thereby, easily pull out the third ejection tray 107, in a state where the first ejection tray 105, the second ejection tray 106, the third ejection tray 107 and the stopper 108 are accommodated in the lower housing 101.

Figure 8:
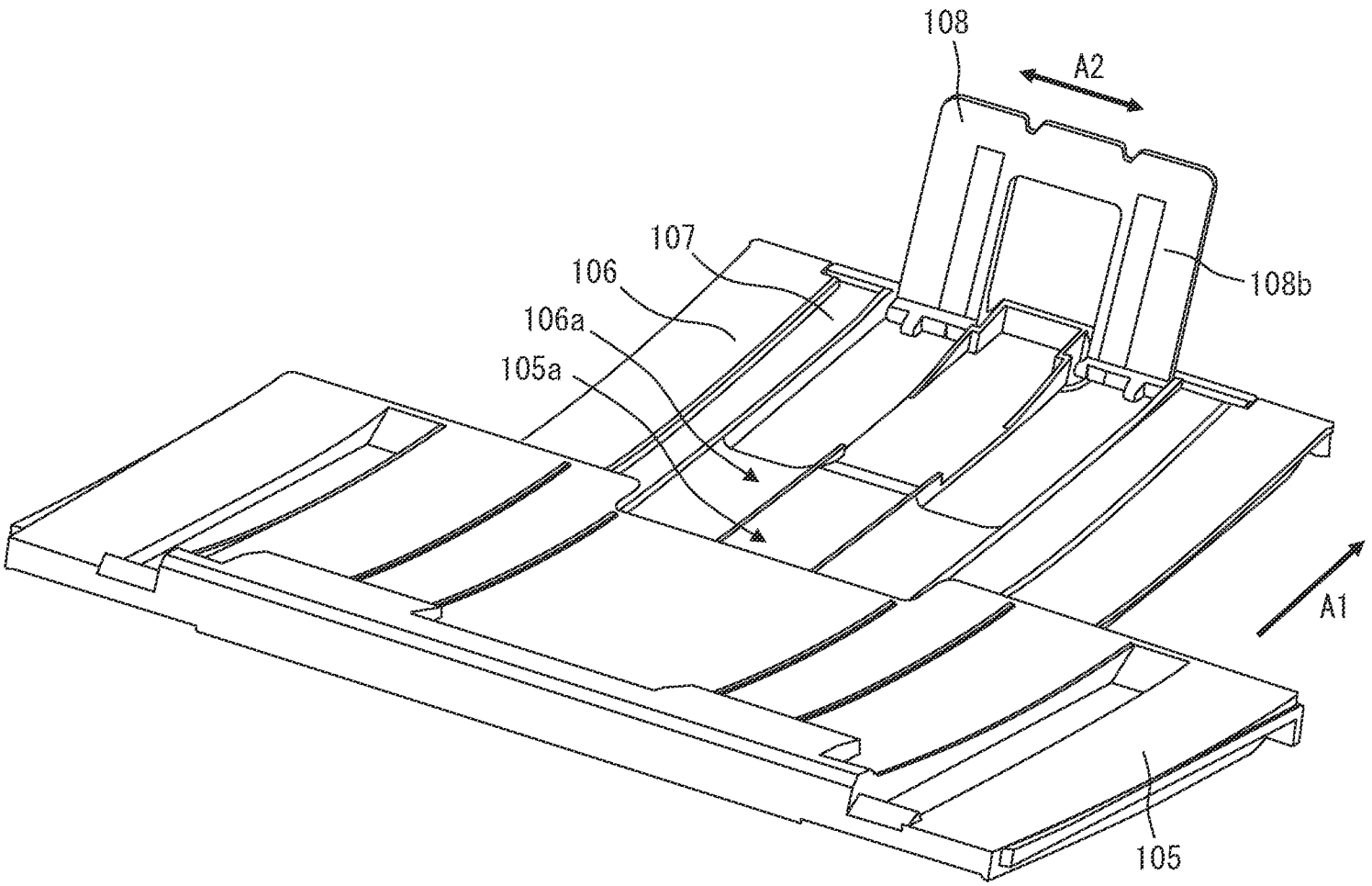
FIG. 8 is a schematic diagram for illustrating the stopper 108.

FIG. 8 illustrates a state where the third ejection tray 107 is accommodated in the second ejection tray 106 from the state shown in FIG. 4. As described above, the second ejection tray 106 is provided with the recess portion 106*a* opened upward. Therefore, the medium ejecting apparatus 100 can accommodate the third ejection tray 107 in the second ejection tray 106 in a state where the stopper 108 rises. Thus, the regulating surface 108*b* can stop the front end of the medium and satisfactorily align the front end of the medium.

Figure 9:
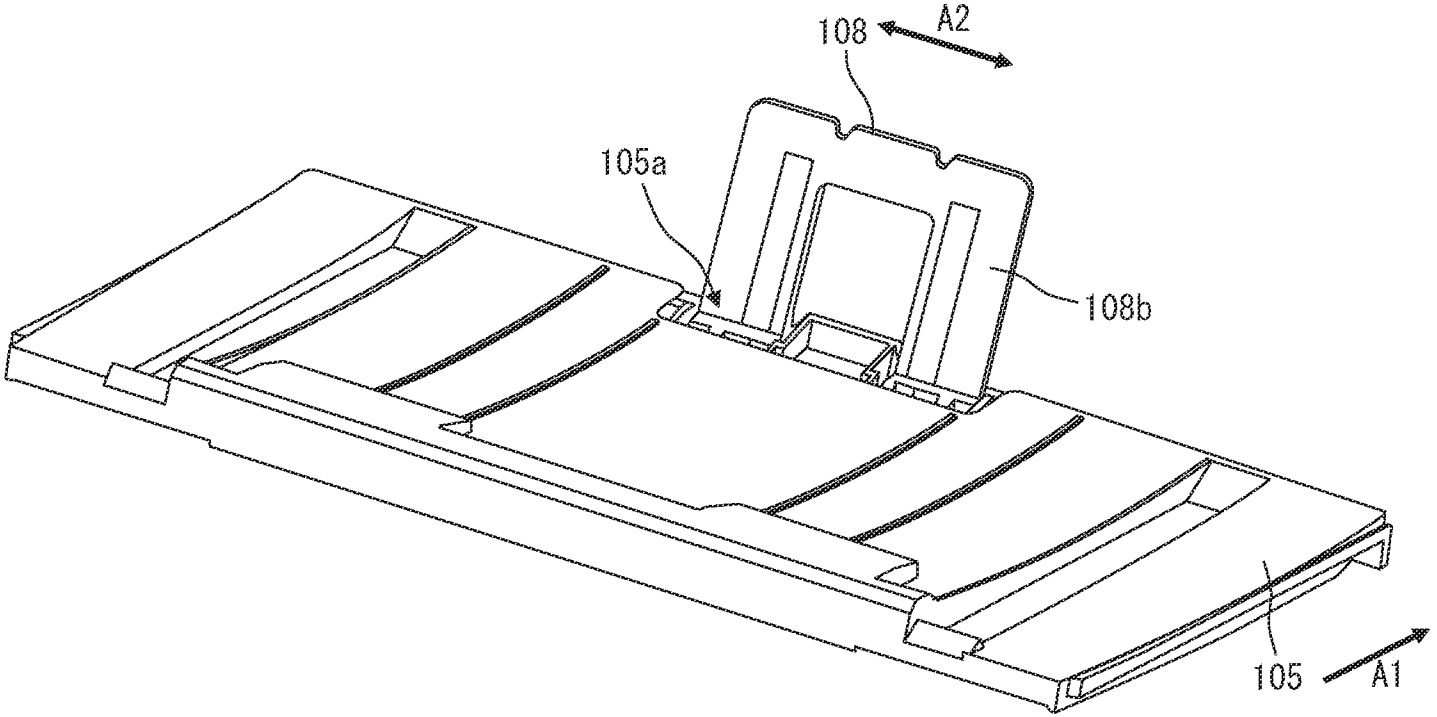
FIG. 9 is a schematic diagram for illustrating the stopper 108.

FIG. 9 illustrates a state where the second ejection tray 106 and the third ejection tray 107 are further accommodated in the first ejection tray 105 from the state shown in FIG. 8. As described above, the second ejection tray 106 and the first ejection tray 105 are provided with the recess portion 106*a* and the recess portion 105*a* opened upward, respectively. Therefore, the medium ejecting apparatus 100 can accommodate the second ejection tray 106 and the third ejection tray 107 in the first ejection tray 105 in a state where the stopper 108 rises. Thus, the regulating surface 108*b* can stop the front end of the small-sized medium and satisfactorily align the front end of the small medium.

As described above, the upper housing 102 is provided so as to be opened and closed with respect to the lower housing 101. The upper housing 102 is provided so as not to contact the stopper 108 in the risen state when opened and closed while each ejection tray is in the state shown in FIG. 5, 8, 9 or 1. That is, the upper housing 102 is provided so as not to contact the stopper 108 in the risen state during the opening and closing operation in a state where all the ejection trays are deployed, a state where only the third ejection tray 107 is accommodated, a state where only the first ejection tray 105 is deployed and a state where all the discharge trays are accommodated. Thus, even when the user opens and closes the upper housing 102 while the stopper 108 is in the risen state, it is suppressed that the upper housing 102 comes into contact with the stopper 108 and damages the stopper 108.

Figure 10:
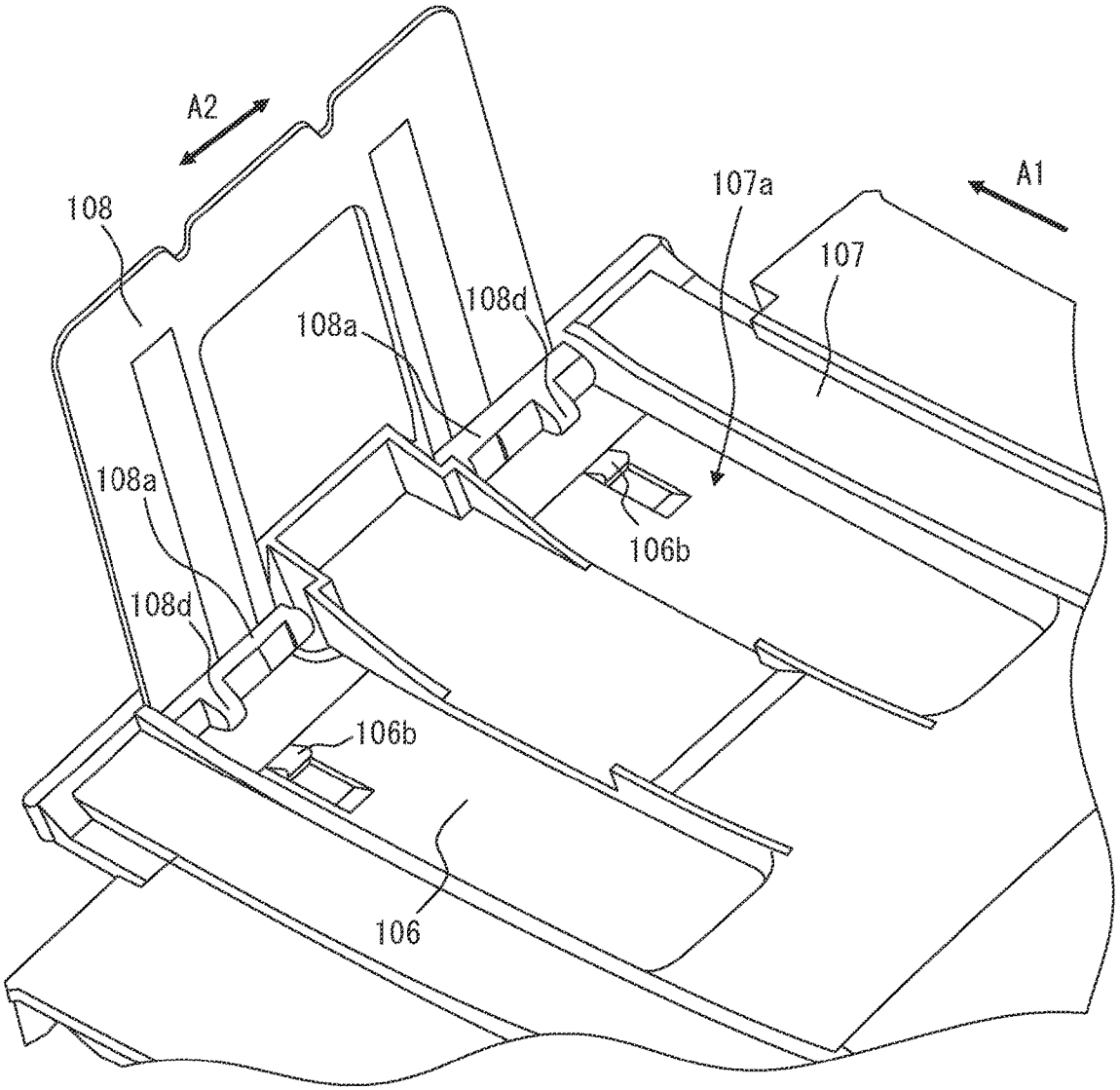
FIG. 10 is a schematic diagram for illustrating an operation of the stopper 108.

FIGS. 10, 11A, 11B, 12A and 12B are schematic diagrams for illustrating an operation of the stopper 108. FIG. 10 is a perspective view of the second ejection tray 106, the third ejection tray 107 and the stopper 108. FIGS. 11A, 11B, 12A and 12B are cross-sectional views taken along A-A' line in FIG. 6.

Figure 11A:
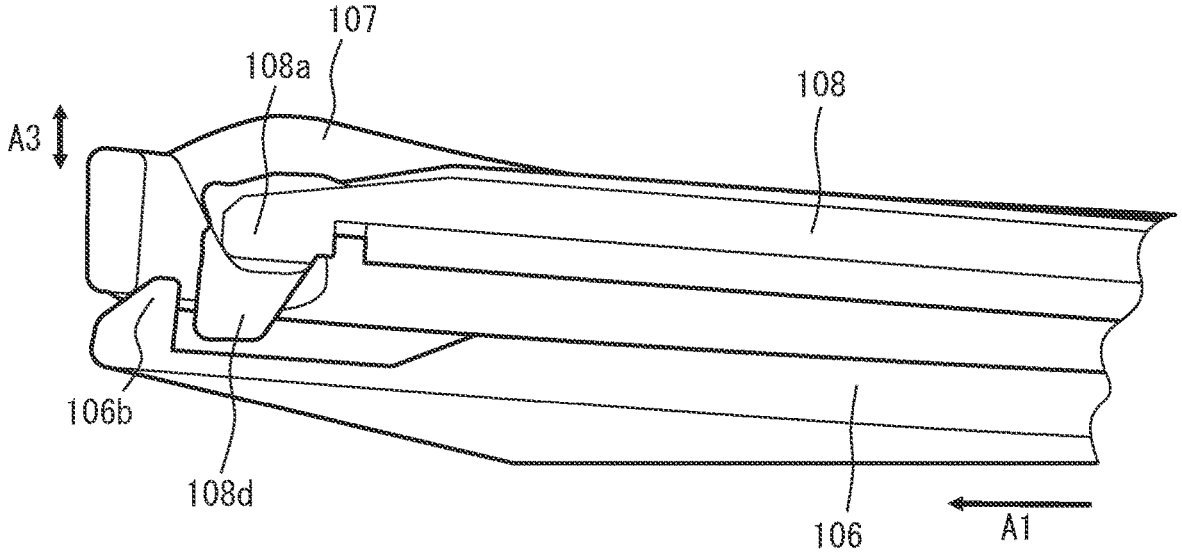
FIG. 11A is a schematic diagram for illustrating the operation of the stopper 108.

FIG. 10 illustrates the third ejection tray 107 in a state of being slightly pulled out from the second ejection tray 106. FIG. 11A illustrates the stopper 108 in the laid state and accommodated in the second ejection tray 106 together with the third ejection tray 107. As illustrated in FIGS. 10 and 11A, an arm 108*a* of the stopper 108 is provided with a slid portion 108*d*. The slid portion 108*d* has a protruding shape projecting downward, i.e., toward the second ejection tray 106 side when the stopper 108 is in the laid state. On the other hand, the second ejection tray 106 is provided with a sliding portion 106*b* at a position facing the slid portion 108*d* of the stopper 108 in the laid state. The sliding portion 106*b* has a protruding shape projecting upward, i.e. the stopper 108 side.

The protruding shape provided on the sliding portion 106*b* and the slid portion 108*d* may have any shape such as a circular shape, a rectangular shape, a triangular shape, a cam shape, etc. However, the protrusion shape provided on the slid portion 108*d* preferably has a planar side surface that contacts the protrusion shape provided on the sliding portion 106*b*. Further, the projection shape provided on the sliding portion 106*b* preferably has a cam shape including a planar side surface and an arc-shaped top surface so that the slid portion 108*d* slides smoothly.

Figure 11B:
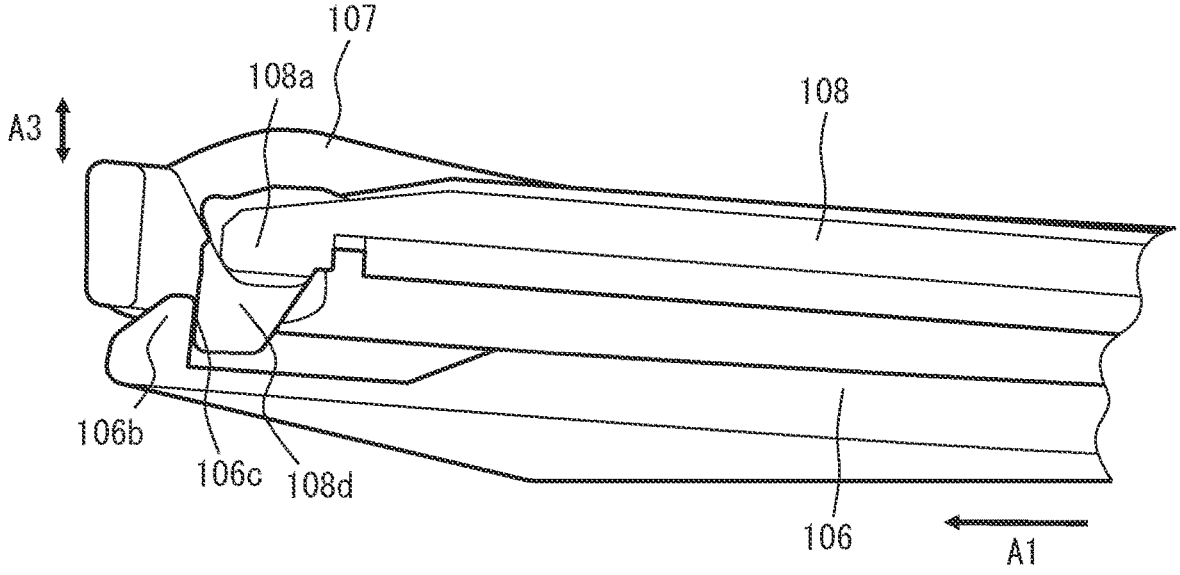
FIG. 11B is a schematic diagram for illustrating the operation of the stopper 108.

FIG. 11B illustrates a state where the third ejection tray 107 is pulled out from the second ejection tray 106 in the medium ejecting direction A1 by the user with the stopper 108 accommodated in the second ejection tray 106 together with the third ejection tray 107. When the third ejection tray 107 is pulled out from the second ejection tray 106, the stopper 108 is pulled out from the second ejection tray 106 together with the third ejection tray 107. Thus, the slid portion 108*d* of the stopper 108 comes into contact with the cam-shaped side surface 106*c* of the sliding portion 106*b* of the second ejection tray 106.

Figure 12A:
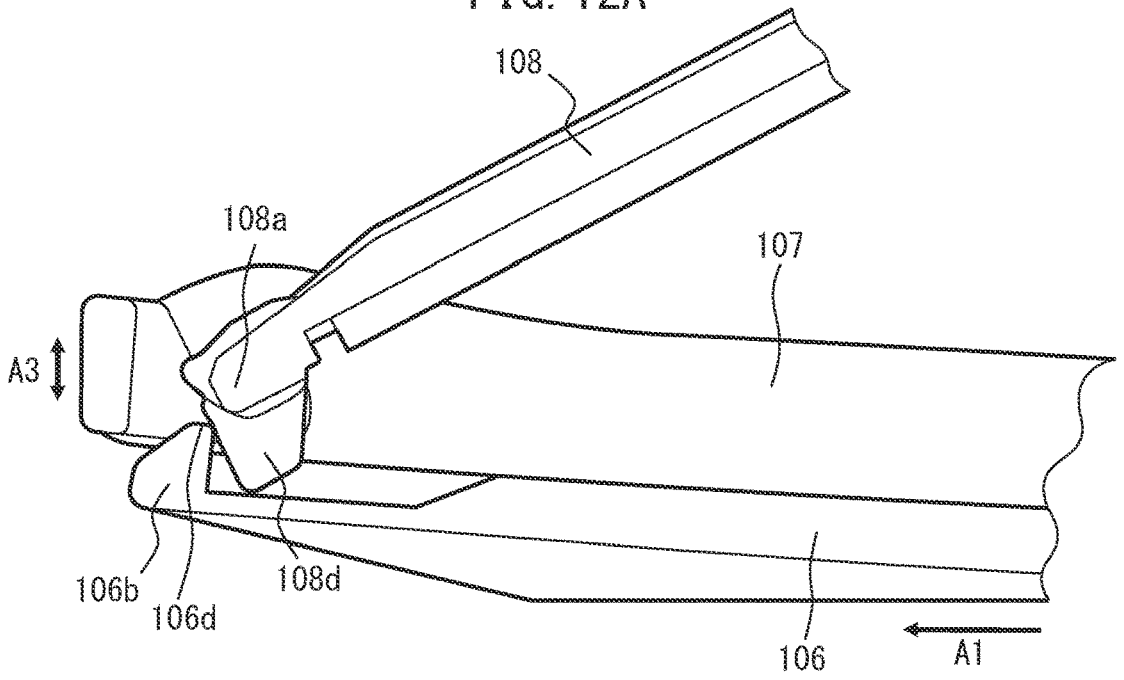
FIG. 12A is a schematic diagram for illustrating the operation of the stopper 108.

FIG. 12A illustrates a state where the third ejection tray 107 is further pulled out from the second ejection tray 106 with respect to the state of FIG. 11B. When the third ejection tray 107 is further pulled out from the second ejection tray 106, the slid portion 108*d* of the stopper 108 slides along the sliding portion 106*b* of the second ejection tray 106, and comes into contact with the cam-shaped top surface 106*d*. Thus, the stopper 108 gradually rises from the laid state.

Figure 12B:
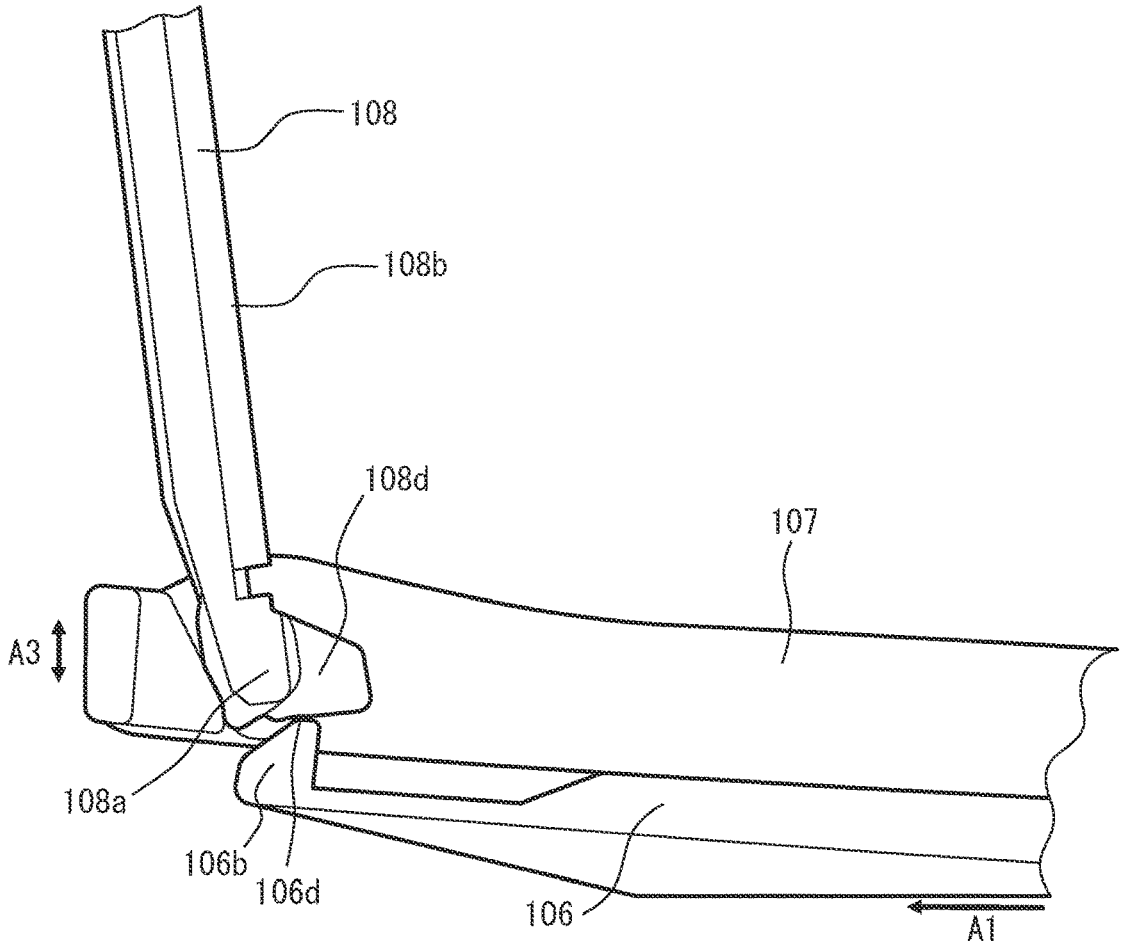
FIG. 12B is a schematic diagram for illustrating the operation of the stopper 108.

FIG. 12B illustrates a state where the third ejection tray 107 is further pulled out from the second ejection tray 106 with respect to the state of FIG. 12A. When the third ejection tray 107 is further pulled out from the second ejection tray 106, the slid portion 108*d* of the stopper 108 slides along the top surface 106*d* of the sliding portion 106*b* of the second ejection tray 106, and the stopper 108 rises. Thus, the regulating surface 108*b* is located at a position facing the front end of the medium ejected on the ejection tray 104, and thereby, can stop the front end of the medium ejected on the ejection tray 104 and align by regulating the front end of each medium.

In this manner, the sliding portion 106*b* slides with respect to the slid portion 108*d* in response to the operation in which the third ejection tray 107 is pulled out from the second ejection tray 106, to raise the stopper 108. Thus, the medium ejecting apparatus 100 can reliably raise the stopper 108 when the ejection tray 104 is utilized. Therefore, the medium ejecting apparatus 100 can prevent the medium from flying out from the ejection tray 104 and scattering while aligning the front end of the medium by reliably stopping the ejected medium. Further, since the stopper 108 rises in conjunction with the operation in which the third ejection tray 107 is pulled out, the user does not need to raise the stopper 108, and thereby, the medium ejecting apparatus 100 can improve the convenience of the user.

Figure 13A:
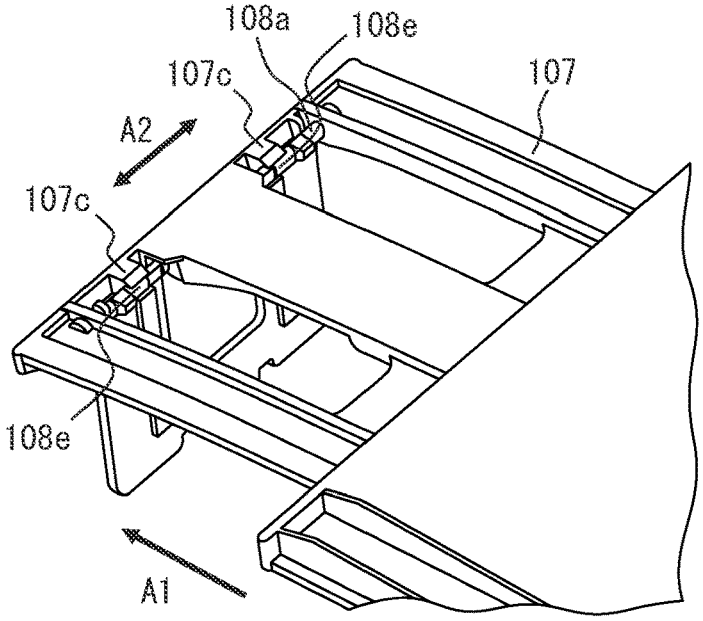
FIG. 13A is a schematic diagram for illustrating a stopper 108 in a risen state.
Figure 13B:
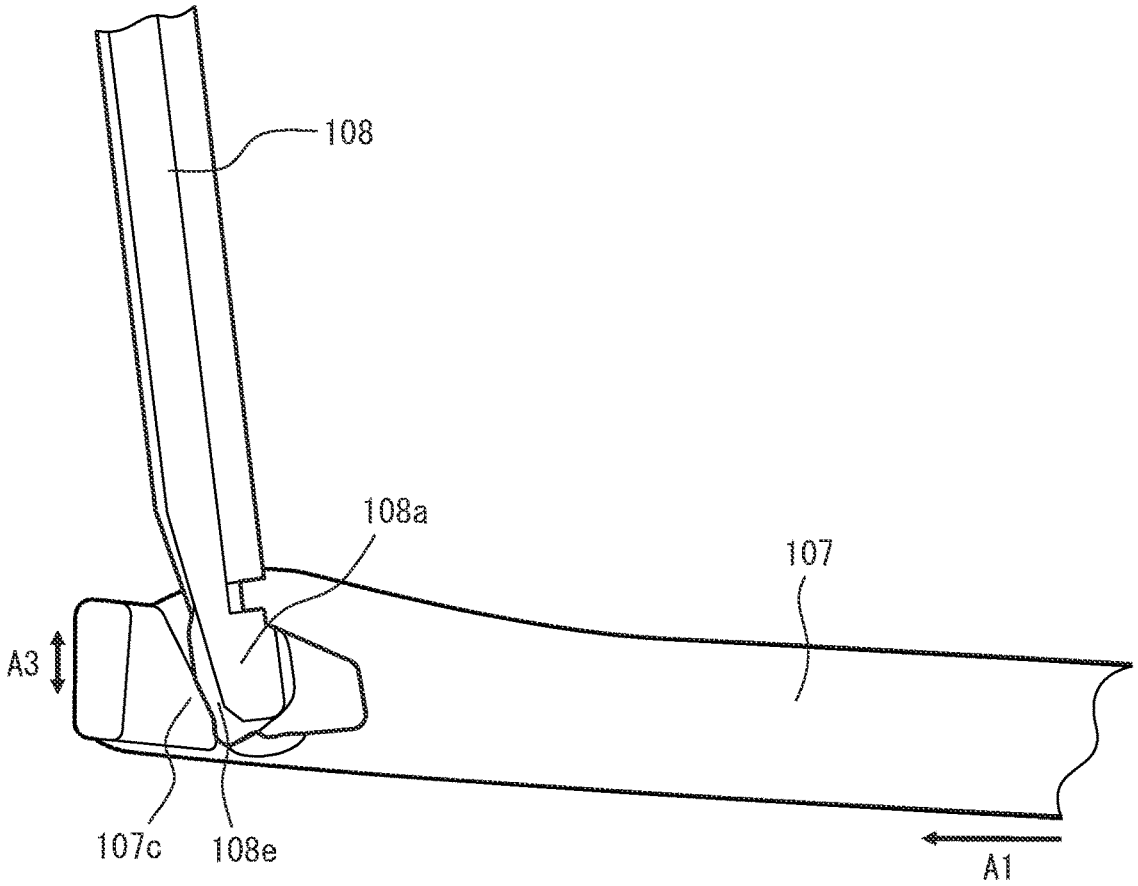
FIG. 13B is a schematic diagram for illustrating a stopper 108 in a risen state.

FIGS. 13A and 13B are schematic diagrams for illustrating the stopper 108 in the risen state. FIG. 13A is a perspective view of the third ejection tray 107 from the lower side. FIG. 13B is a cross-sectional view taken along B-B' line in FIG. 4.

As illustrated in FIGS. 13A and 13B, the arm 108*a* of the stopper 108 is provided with a locked portion 108*e*. On the other hand, the third ejection tray 107 is provided with a locking portion 107*c* at a position facing the locked portion 108*e* of the stopper 108 in the risen state. The locking portion 107*c* is separated from the locked portion 108*e* in a state where the stopper 108 is laid, and comes into contact with the locked portion 108*e* in a state where the stopper 108 rises. Thus, the locking portion 107*c* locks with the locked portion 108*e* in a state where the stopper 108 rises. The medium ejecting apparatus 100 can stop the stopper 108 in the risen state by the locking portion 107*c* and the locked portion 108*e*, and thereby, prevent the medium from flying out from the ejection tray 104 and scattering while aligning the front end of the medium by reliably stopping the ejected medium.

When the locked portion 108*e* is locked by the locking portion 107*c*, the stopper 108 is maintained in the risen state until the stopper 108 is folded by the user. Thus, as illustrated in FIGS. 8 and 9, the stopper 108 can continue to rise when in a state where the third ejection tray 107, or, the third ejection tray 107 and the second ejection tray 106 are accommodated. Therefore, the medium ejecting apparatus 100 can stop the front end of the small-sized medium or the medium-sized medium, and thereby, satisfactorily align the front end of the small-sized medium or the medium-sized medium.

Figure 14:
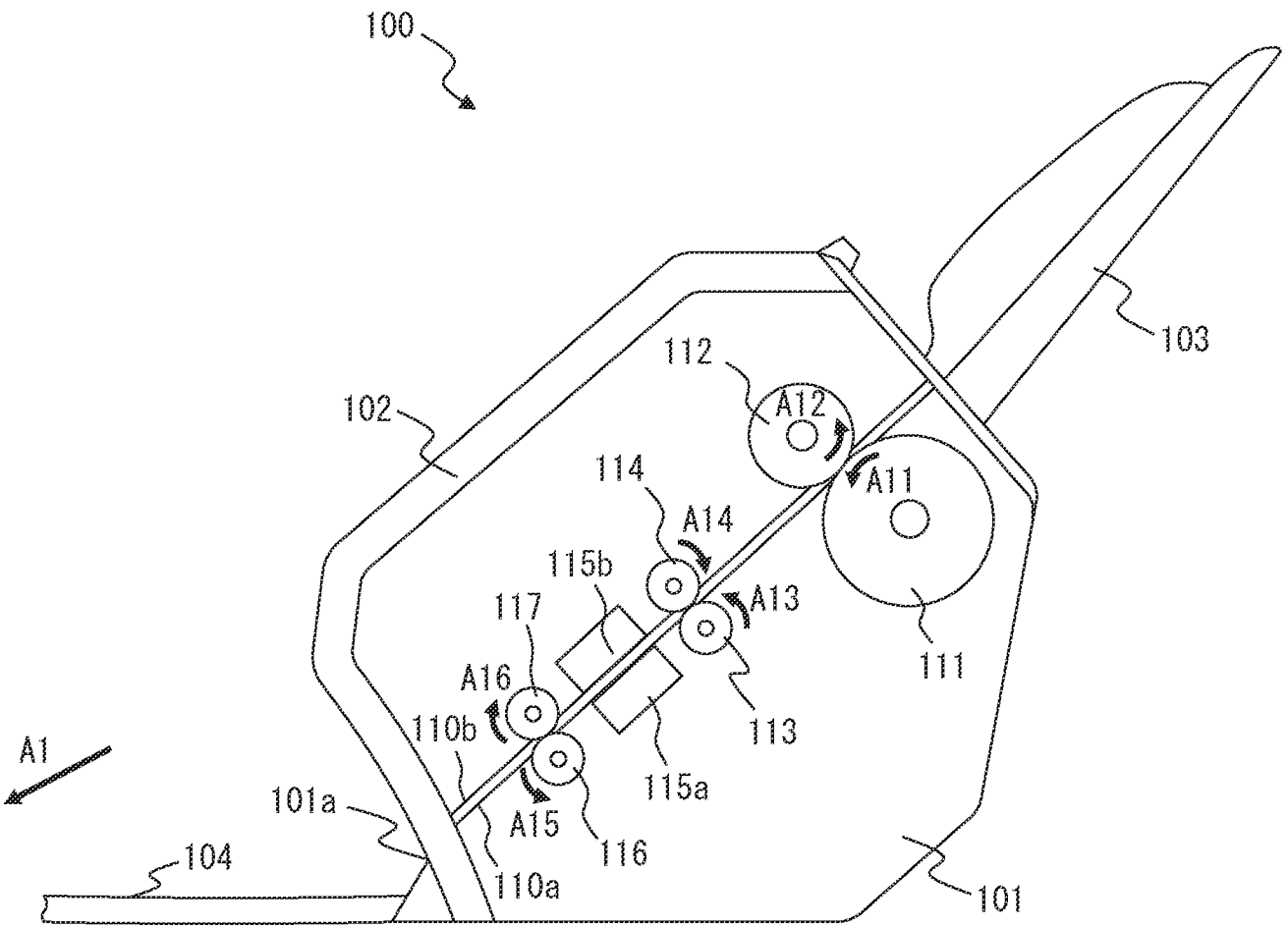
FIG. 14 is a diagram for illustrating a conveyance path inside the medium ejecting apparatus 100.

FIG. 14 is a diagram for illustrating a conveyance path inside the medium ejecting apparatus 100.

The conveyance path inside the medium ejecting apparatus 100 includes a feed roller 111, a brake roller 112, a first conveyance roller 113, a second conveyance roller 114, a first imaging device 115*a*, a second imaging device 115*b*, a first ejection roller 116 and a second ejection roller 117, etc. The number of each roller is not limited to one, and may be plural. A top surface of the lower housing 101 forms a lower guide 110*a* of a conveyance path of a medium, and a bottom surface of the upper housing 102 forms an upper guide 110*b* of the conveyance path of a medium.

The lower guide 110*a* and the upper guide 110*b* are formed in a substantially planar shape (substantially straight when viewed from the side) in order to satisfactorily convey a rigid medium such as a passport or a brochure. The lower guide 110*a* and the upper guide 110*b* are located at an angle equal to or more than a predetermined angle with respect to the horizontal plane in order to improve the conveying speed of the medium. The predetermined angle is, for example, 35°. As described above, since the ejection tray 104 is provided so as to be substantially parallel to the horizontal plane, the medium ejecting apparatus 100 can suppress the front end of the rigid medium ejected from the ejecting port 101*a* at a high speed from colliding with the ejection tray 104 at an angle close to vertical and being damaged. Further, since the stopper 108 is set reliably, the medium ejecting apparatus 100 can reliably stop the medium moving at high speed on the ejection tray 104 and suppress the medium from flying out from the ejection tray 104.

The first imaging device 115*a* includes a line sensor based on a unity-magnification optical system type contact image sensor (CIS) including an imaging element based on a complementary metal oxide semiconductor (CMOS) linearly located in a main scanning direction. Further, the first imaging device 115*a* includes a lens for forming an image on the imaging element, and an analog-digital (A/D) converter for amplifying and analog-digital (A/D) converting an electric signal output from the imaging element. The first imaging device 115*a* generates and outputs an input image imaging a front surface of a conveyed medium, in accordance with control from a processing circuit (not shown).

Similarly, the second imaging device 115*b* includes a line sensor based on a unity-magnification optical system type CIS including an imaging element based on a CMOS linearly located in a main scanning direction. Further, the second imaging device 115*b* includes a lens for forming an image on the imaging element, and an A/D converter for amplifying and A/D converting an electric signal output from the imaging element. The second imaging device 115*b* generates and outputs an input image imaging a back surface of a conveyed medium, in accordance with control from the processing circuit.

Only either of the first imaging device 115*a* and the second imaging device 115*b* may be located in the medium ejecting apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The medium placed on the medium tray 103 is conveyed in the medium ejecting direction A1 between the lower guide 110*a* and the upper guide 110*b* by the feed roller 111 rotating in a direction of an arrow A11 in FIG. 14. When the medium is conveyed, the brake roller 112 rotates in a direction of an arrow A12. By the workings of the feed roller 111 and the brake roller 112, when a plurality of media are placed on the medium tray 103, only a medium in contact with the feed roller 111, out of the media placed on the medium tray 103, is separated. Consequently, conveyance of a medium other than the separated medium is restricted (prevention of multi-feed)

The medium is fed between the first conveyance roller 113 and the second conveyance roller 114 while being guided by the lower guide 110*a* and the upper guide 110*b*. The medium is fed between the first imaging device 115*a* and the second imaging device 115*b* by the first conveyance roller 113 and the second conveyance roller 114 rotating in directions of an arrow A13 and an arrow A14, respectively, and is read by the first imaging device 115*a* and the second imaging device 115*b*. The first ejection roller 116 and the second ejection roller 117 eject the medium on the ejection tray 104 by rotating in directions of arrows A15 and A16, respectively. The ejection tray 104 places the medium ejected by the first ejection roller 116 and the second ejection roller 117.

As described in detail above, the medium ejecting apparatus 100 raise the stopper 108 rotatably provided in the third ejection tray 107 provided so as to be pulled out from the second ejection tray 106, in response to the operation in which the third ejection tray 107 is pulled out from the second ejection tray 106. Thus the medium ejecting apparatus 100 can automatically set the stopper 108 during a series of operations of the user setting the third ejection tray 107. Therefore, the medium ejecting apparatus 100 can more reliably set the stopper 108 in the third ejection tray 107.

According to embodiments, the medium ejecting apparatus can more reliably set the stopper in the tray.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A medium ejecting apparatus comprising:

an ejection roller to eject medium;

a first tray, provided with a contacting portion, to place the medium ejected by the ejection roller;

a second tray provided to be pulled out from the first tray; and a stopper accommodated in the first tray together with the second tray in a laid state, rotatably supported at a downstream end portion in a medium ejecting direction of the second tray, and provided with a contacted portion, wherein the stopper the stopper is configured to be raised by the contacted portion rotating along the contacting portion while being in contact with the contacting portion, in response to an operation in which the second tray is pulled out from the first tray.

2. The medium ejecting apparatus according to claim 1, wherein the contacted portion has a protruding shape, and wherein the contacting portion has a cam shape.

3. The medium ejecting apparatus according to claim 1, wherein the second tray is provided with a locking portion, and wherein the stopper is provided with a locked portion locked with the locking portion in a risen state.

4. The medium ejecting apparatus according to claim 1, wherein the stopper has a notch for exposing the downstream end portion in the medium ejecting direction of the second tray.

* * * * *